US008640913B2

(12) United States Patent
Berendes

(10) Patent No.: US 8,640,913 B2
(45) Date of Patent: Feb. 4, 2014

(54) TRANSPORT CONTAINER, IN PARTICULAR FOR STORING SECURITIES

(75) Inventor: Elmar Berendes, Warburg (DE)

(73) Assignee: Wincor Nixdorf International GmbH (DE)

( * ) Notice: Subject to any disclaimer, the term of this patent is extended or adjusted under 35 U.S.C. 154(b) by 203 days.

(21) Appl. No.: 13/000,400

(22) PCT Filed: Jun. 23, 2009

(86) PCT No.: PCT/EP2009/057791
§ 371 (c)(1),
(2), (4) Date: Dec. 21, 2010

(87) PCT Pub. No.: WO2009/156387
PCT Pub. Date: Dec. 30, 2009

(65) Prior Publication Data

US 2011/0101013 A1 May 5, 2011

(30) Foreign Application Priority Data

Jun. 23, 2008 (DE) ..... 10 2008 029 629

(51) Int. Cl.
*A45C 13/26* (2006.01)

(52) U.S. Cl.
USPC ..... 220/752; 190/115; 16/409

(58) Field of Classification Search
USPC ..... 220/752; 206/508; 190/115, 107, 11 A; 16/405, 429, 444, 408, 409
See application file for complete search history.

(56) References Cited

U.S. PATENT DOCUMENTS

| | | | | | |
|---|---|---|---|---|---|
| 2,254,506 | A | * | 9/1941 | Wheary, Jr. | 16/409 |
| D153,660 | S | * | 5/1949 | Arbib | D3/281 |
| 3,113,651 | A | * | 12/1963 | Szabo et al. | 16/405 |
| 4,117,914 | A | * | 10/1978 | Snyder | 190/115 |
| 4,157,763 | A | * | 6/1979 | Betlejewski et al. | 220/761 |
| 4,638,746 | A | * | 1/1987 | Ishigure | 109/52 |
| 4,659,008 | A | | 4/1987 | Howett et al. | |
| 4,905,711 | A | | 3/1990 | Bennett et al. | |
| 4,928,800 | A | * | 5/1990 | Green et al. | 190/115 |
| 6,389,645 | B1 | | 5/2002 | Polidoro | |

(Continued)

FOREIGN PATENT DOCUMENTS

| | | | |
|---|---|---|---|
| CN | 2245891 | Y | 1/1997 |
| DE | 875959 | C | 5/1953 |
| DE | 20118843 | U1 | 4/2003 |
| WO | WO-0129786 | A1 | 4/2001 |

OTHER PUBLICATIONS

Translation of International Preliminary Report on Patentability for PCT/EP2009/057791 (Jan. 27, 2011).

*Primary Examiner* — Steven A. Reynolds
*Assistant Examiner* — Ernesto Grano
(74) *Attorney, Agent, or Firm* — Harness, Dickey & Pierce, P.L.C.

(57) ABSTRACT

A transport container, in particular for storing notes of value, with a container body (12, 12*a*, 12*b*) which has at least one storage area (36, 36*a*, 36*b*) for storing the notes of value and a handle (16, 16*a*, 16*b*) connected to the container body (12, 12*a*, 12*b*). The handle (16, 16*a*, 16*b*) and the container body (12, 12*a*, 12*b*) are connected by at least one connecting element (38, 38*a*, 38*b*). The handle (16, 16*a*, 16*b*) is arranged displaceably relative to the container body (12, 12*a*, 12*b*) via the connecting element (38, 38*a*, 38*b*). Further, the invention relates to an arrangement with two transport containers.

22 Claims, 6 Drawing Sheets

(56) References Cited

U.S. PATENT DOCUMENTS 6,467,130 B2 * 10/2002 Kurachi et al. ..... 16/438
6,889,838 B2 * 5/2005 Meier et al. ..... 206/508
7,419,037 B2 * 9/2008 Nordstrom ..... 190/107
D644,815 S * 9/2011 Helm et al. ..... D99/34
2008/0041756 A1 * 2/2008 Tasman ..... 206/508
2011/0168729 A1 * 7/2011 Koenig et al. ..... 220/761

* cited by examiner

TRANSPORT CONTAINER, IN PARTICULAR FOR STORING SECURITIES

CROSS-REFERENCE TO RELATED APPLICATIONS

This application is a National Stage of International Application No. PCT/EP2009/057791, filed Jun. 23, 2009. This application claims the benefit and priority of German application 10 2008 029 629.5 filed Jun. 23, 2008. The entire disclosures of the above applications are incorporated herein by reference.

BACKGROUND

This section provides background information related to the present disclosure which is not necessarily prior art.

1. Technical Field

The invention relates to a transport container that is adapted to store and transport notes of value. Such notes of value are, for example, banknotes, checks or vouchers. The transport container comprises a container body with at least one storage area for storing the notes of value as well as at least one handle connected to the container body. The handle serves in particular as a transport handle. For transporting the container, a person can reach with one hand into or through a handle opening of the transport handle. Transport containers for transporting notes of value and having a transport handle are known, for example, from the document WO 01/29786 A1.

2. Discussion

For an easy carrying, it is useful to arrange the handle leg or the handle legs connected to the container in a center-of-gravity plane or in a plane parallel to the center-of-gravity plane and near the center-of-gravity plane. As a result thereof, a relatively easy and comfortable carrying of the container is made possible. For many applications, it is desirable to be able to lift and carry two containers at the same time with a single hand without any further auxiliary means. From the document DE 201 18 843 U1, a separable transport container is known in which the two parts of the transport container can be jointly gripped by jointly grasping two carrying handles connected to the partial containers. These partial containers require that snap-in elements be provided by which the two partial containers are connected to each other so that the partial containers can be jointly carried.

SUMMARY OF THE INVENTION

It is an object of the invention to specify a transport container which can be carried easily both individually and also together with a further transport container.

This object is solved by an arrangement with two transport containers. Advantageous developments of the invention are specified in the dependent claims.

The transport container can be carried and transported with a single hand both comfortably as an individual container and also together with at least one further container. By displacing the handle relative to the container body it is in particular possible to arrange the handle in a first transport position for the transport as an individual transport container and in a second transport position different from the first transport position for the transport together with a second transport container. For this, an easy displacement of the handle via the connecting element and/or with the connecting element is sufficient so that no assembly work for changing the position of the handle is required.

It is advantageous to provide a handle having two handle legs and one handle crossbar connecting the handle legs. The handle crossbar preferably connects one end each of each handle leg to the other. Each of the other ends of each handle leg is connected via the connecting element to the container body. In particular, the connecting element engages with an opening provided in the container body or a guide provided in the container body. As a result thereof, a handle opening delimited by the handle legs, the handle crossbar and the container body can be created easily, through which opening a person carrying the container can grasp the handle crossbar with a single hand. In other embodiments, also handles can be provided having only one handle leg and/or several handle crossbars, in particular with one handle leg and with an annular element providing a grasping opening.

In an advantageous development of the invention, the handle is a transport handle designed as a bow-type handle. Such a bow-type handle can be manufactured easily and cost-efficiently, offers good carrying properties as a transport handle and can be connected relatively easily to the container body via simple connecting elements.

Further, it is advantageous to arrange the handle in a recess provided in the container body. The recess can be provided in a front side of the transport container, the front side of the transport container being arranged substantially orthogonally to the longitudinal axis of the container body. In this connection, it is advantageous when at least one joint between handle and container body is arranged in the recess and the handle projects from the recess at least in a transport position so that at least a part of the handle opening projects from the recess. As a result thereof, a person can simply reach through the handle opening and grasp an area of a handle crossbar with the hand for a transport of the container.

Given a substantially vertical arrangement of the longitudinal axis of the transport container, the longitudinal axis of the container body extends through the center-of-gravity plane of the filled and/or unfilled transport container. In this connection, the center-of-gravity plane of the filled and/or unfilled transport container can extend substantially parallel to the underside and/or upper side of the transport container when the transport container is installed in an automated teller machine. When the transport container is arranged in the installation position, its longitudinal axis is arranged horizontally.

It is particularly advantageous when the handle does not project from the recess provided in the container body in a first neutral position and that the handle projects from this recess in a first transport position so that a grasping opening formed by the handle is arranged in the center-of-gravity plane or in a plane parallel to the center-of-gravity plane and near the center-of-gravity plane. It is particularly advantageous when the grasping opening is arranged in the center-of-gravity plane or in a first plane parallel to the center-of-gravity plane and near the center-of-gravity plane in the first transport position and that the grasping opening is arranged in a second plane parallel to the center-of-gravity plane in a second transport position, the second plane having a distance to the center-of-gravity plane or, respectively, a greater distance to the center-of-gravity plane than the parallel first plane. The parallel second plane is preferably arranged between the center-of-gravity plane and the underside of the container body.

The transport container can preferably be arranged in a rack frame. When the transport container is arranged in the rack frame, the underside of the container body is arranged substantially in a horizontal plane and a front side of the container body connected to the handle via the connecting element is arranged substantially vertically. With the aid of the handle, the transport container can at least easily be pulled out of the rack frame. When the handle can be folded in into the recess provided in the container body, then the handle is folded in at least after insertion of the container into the rack frame so that a relatively small space requirement must be provided for the transport container.

Further, it is advantageous that a restoring element is provided which exerts a restoring force on the handle at least into the first transport position and/or into the neutral position. Such a restoring element can, for example, be a spring exerting a suitable spring force on the handle. Further, it is advantageous to displace the handle together with the connecting element, the connecting element preferably engaging with at least one guide rail. In particular, the handle and the connecting element or, respectively, the connecting element and the container body can form a sliding block guide for displacing the handle. For example, the handle can be displaced together with the at least one connecting element from the first transport position into the third state. The at least one connecting element preferably engages with at least one guide rail and/or guide groove. The connecting element can be at least one engagement element projecting from the handle. The engagement element can be connected firmly or rotatably to the handle or can be integrally formed with the handle.

Further, it is advantageous to arrange the center-of-gravity plane of the transport container vertically when the transport container is arranged in a transport position. This is particularly advantageous when the transport container is carried by a person using the handle. In the transport position, the handle arranged in the first or second transport position projects upwardly from the front side of the container body.

It is particularly advantageous when a fixing arrangement for keeping the handle in the second transport position is provided. The fixing arrangement can include a snap-in element with which a part of the handle and/or the at least one locking element engages in the second transport position so that the handle is held in the second transport position. As a result thereof, an undesired restoring motion of the handle into the first transport position and into the neutral position can be prevented.

A further aspect of the invention relates to an arrangement with two inventive transport containers, in which the transport containers are arranged such that one of the at least four longitudinal sides of the first container is arranged opposite to one of the at least four longitudinal sides of the second transport container. The handles of the transport containers can be displaced towards the opposite longitudinal side of the respective other transport container via the at least one respective connecting element so that the distance between the handles is reduced in the second transport position as compared to the first transport position. Preferably, the distance between the handles is reduced such that the handles can be jointly grasped by a person with a single hand. As a result thereof, the person can comfortably transport two containers at the same time with one hand. Further, it is advantageous to arrange the transport containers opposite to each other with one longitudinal side each, preferably with their undersides. Then, each of the handles can be displaced towards this longitudinal side or, respectively, to the underside of the transport container. The underside of the transport container is usually solidly designed since the respective transport container is inserted with the underside into a rack frame, preferably into a rack frame arranged in a safe of an automated teller machine or in a rack frame formed by the safe, and is accordingly solidly built. Each of the handles is arranged displaceably at the front side of the respective transport container. For an easy carrying of the transport containers, the transport containers are arranged such that the front side with the handle each time forms the upper side of the standing transport container when the latter is arranged in a transport position in which the underside of the transport container in the installation position is arranged vertically. Thus, the transport container can be parked on the front side opposite to the front side with the handle. When the transport containers are each arranged standing on their front side with their undersides, as referred to their installation position in an automated teller machine, arranged opposite to each another, a person can comfortably grasp both handles at the same time with a single hand when the respective handle is displaced towards the underside of the respective transport container. The center-of-gravity plane of the two transport containers lies, at least in the case of empty or uniformly filled transport containers, in the plane between the opposite longitudinal sides so that the two transport containers of the arrangement can be be carried comfortably and easily.

Each of the transport containers of the arrangement can be advantageously developed with the features specified further above for a single transport container.

Notes of value are, in particular, banknotes, vouchers and/or tickets for transport means or events.

BRIEF DESCRIPTION OF THE DRAWINGS

Further features and advantages of the invention result from the following description which in connection with the enclosed figures explains the invention in more detail with reference to an embodiment.

The drawings described herein are for illustrative purposes only of selected embodiments and not all possible implementations, and are not intended to limit the scope of the present disclosure.

FIG. 1 shows a perspective view of a transport container for the transport of notes of value for an automated teller machine in the installation position with the handle folded in.

FIG. 4 shows the longitudinal section according to FIG. 3 with the handle folded in.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
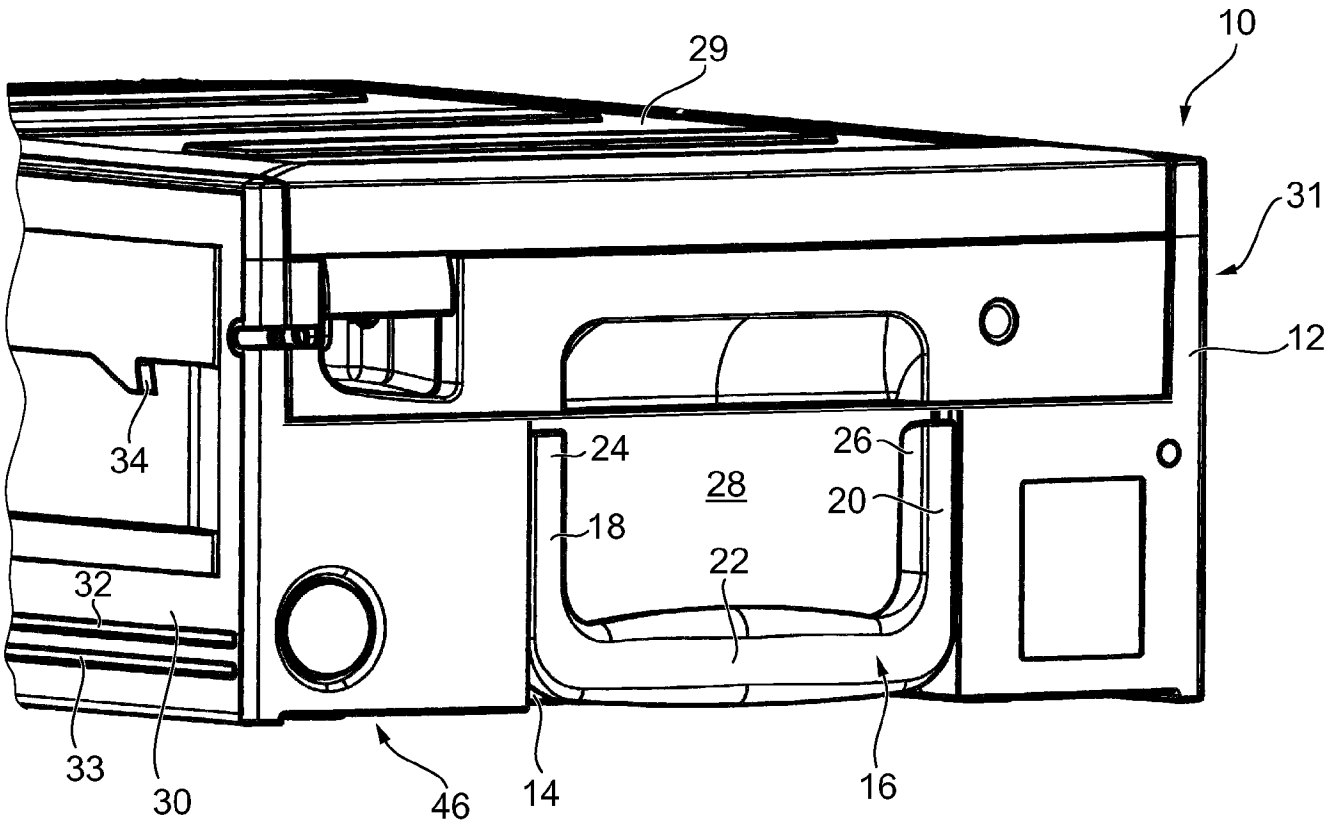

In FIG. 1, a perspective view of a transport container 10 for the transport of notes of value is illustrated, which container can be inserted into an automated teller machine. With the aid of such a transport container 10, notes of value are transported from a head office to the automated teller machine as well as from the automated teller machine to a further automated teller machine or to the head office. Preferably, a valuable transport company takes care of the transport of such transport containers 10. Usually, when the transport containers 10 of an automated teller machine are changed, the valuable transport company changes at least two of these transport containers 10, wherein one person has to carry the at least two transport containers 10 to be inserted into the automated teller machine from a vehicle to the safe of the automated teller machine and, after the transport containers 10 have been changed, the person has to carry the at least two transport containers 10 removed from the safe of the automated teller machine back to the vehicle. For this, known transport containers have a handle which makes a comfortable and reliable carrying of a transport container with a single hand possible. The invention is based on the finding that it is favorable to carry at least two transport containers 10 with a single hand to make the transport of the transport containers 10 by the person efficiently. Such a closed transport container 10 is also referred to as cassette or transport cassette.

Figure 2:
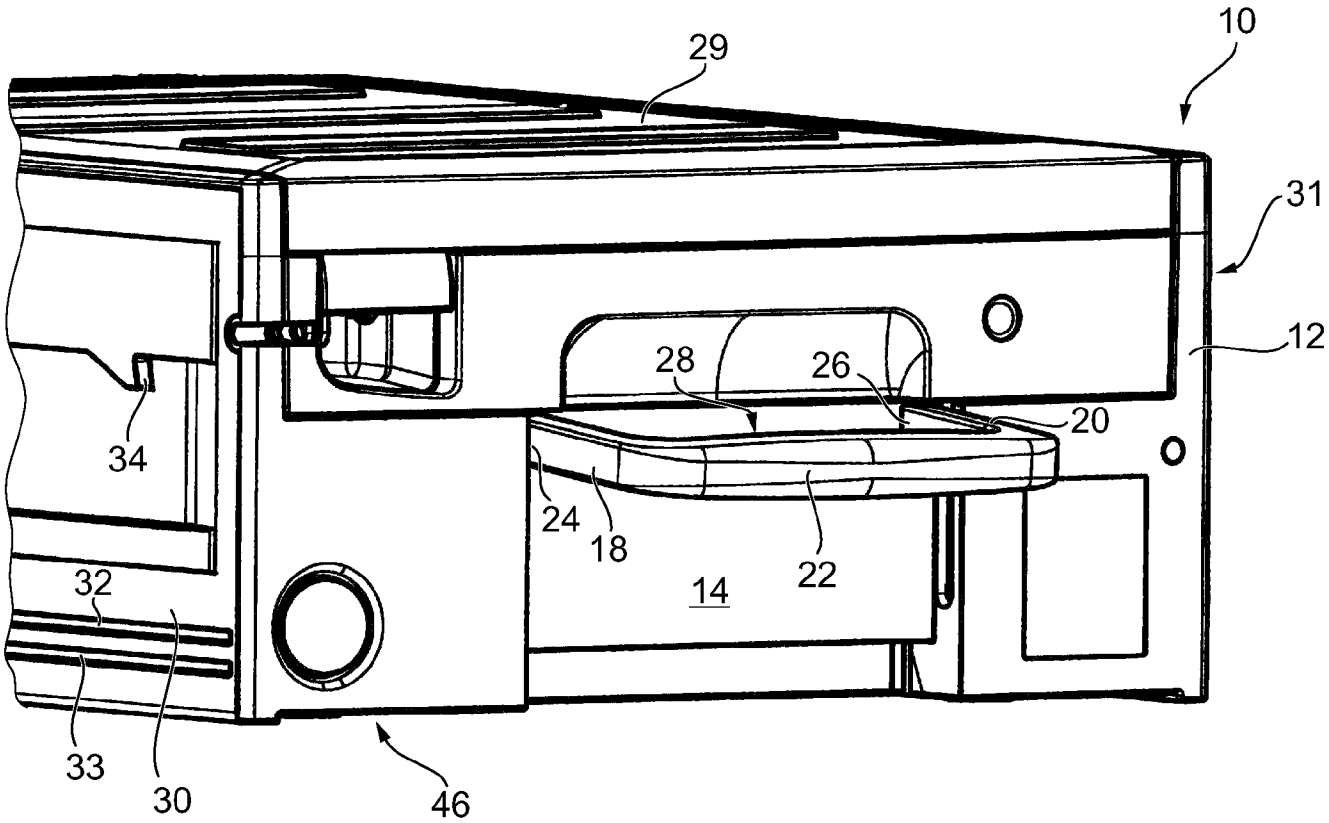
FIG. 2 shows a side view of the container according to FIG. 1 with the handle folded out into a first transport position.

In FIG. 1, the transport container 10 is illustrated in its installation position, i.e. the longitudinal axis of the transport container 10 extends substantially parallel to the horizontal plane in which the transport container 10 is arranged in the illustration according to FIG. 1. The transport container has a container body 12 in which a recess 14 is provided in a front side 15 of the container body 12, in which recess the handle 16 is arranged. In FIG. 1, the handle 16 is illustrated in a folded-in position. The handle 16 has two handle legs 18, 20. One end of the handle legs 18, 20 each is connected via a handle crossbar 22 to the respective other end of the handle legs 18, 20. The ends of the handle legs 18, 20 remote from the handle crossbar 22 are connected to the container body 12 at one joint 24, 26 each and make it possible that the handle 16 is pivoted into the position illustrated in FIG. 2. The handle legs 18, 20 and the handle crossbar 22 form a grasping opening 28. The upper side of the transport container 10 is formed as a cover and can be opened for removing notes of value from the transport container 10 or for filling the transport container. The removal of notes of value and the filling of the transport container 10 with notes of value preferably takes place in a central bank, for example a state bank.

The transport container 10 further has two side walls 30, 31 in each of which guide rails and snap-in elements are integrally formed. The guide rails serve for the insertion and the positioning of the transport container 10 in a rack frame which is provided in the safe of the automated teller machine for receiving transport containers 10. Two lateral guide rails formed on the side wall 30 are identified with the reference signs 32, 33. Further, at least on the outside of the side wall 30 and preferably also, opposite thereto, on the side wall 31 one projecting snap-in nose 34 each is provided into which a locking element preferably loaded with a spring force snaps during insertion of the transport container 10 into the rack frame. When snapping into place, at least a part of the locking element engages behind the snap-in nose 34. As a result thereof or, respectively, after snapping into place, the transport container 10 is locked in the rack frame. For removing the transport container 10 from the rack frame, the engagement between the locking element and the snap-in nose 34 has to be released.

The cross-sections of the handle legs 18, and of the handle crossbar 22 are substantially rectangular, the handle crossbar having rounded edges and preferably a non-stick coating to increase carrying comfort. In the installation position of the transport container 10 and in the folded-in state of the handle 16 shown in FIG. 1, the joints 24, 26 are arranged in the upper half of the recess 14 in the container body 12. The folded-in state of the handle 16 is also referred to as neutral position. In the installation position of the transport container 10 in the rack frame as shown in FIG. 1, the notes of value are preferably arranged upright on their longitudinal edge.

Figure 3:
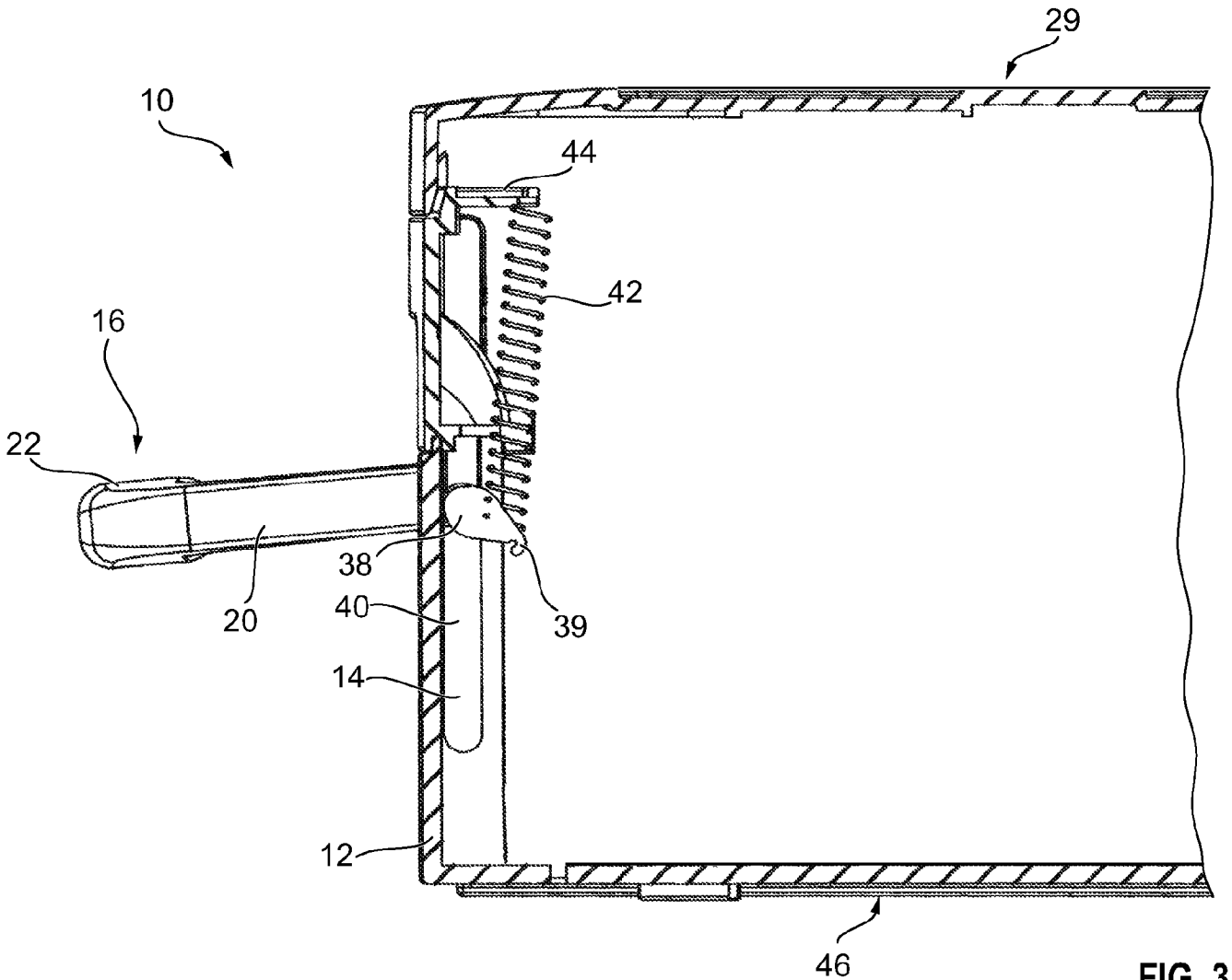
FIG. 3 shows a longitudinal section of a portion of the transport container according to FIGS. 1 and 2 with the handle folded out into the first transport position.

In FIG. 3, a schematic longitudinal section of the transport container 10 with a handle 16 folded out into a first transport position is illustrated. In the transport container 10, a storing space 36 for storing the notes of value is provided. The storing space 36 extends from a feed and/or removal opening, which is preferably provided in the area of the front side opposite to the front side 15, up to the pressure plate of a non-illustrated displacement carriage. By means of a drive unit, the displacement carriage can be displaced along the longitudinal axis of the transport container 10 so that the storing space 36 can be increased and reduced if necessary. In the lower area of the transport container 10, an arrangement with so-called circulating bottom belts is provided. These bottom belts can be driven. On the bottom belts, the notes of value stacked to a stack in the storing space 36 of the transport container 10 are arranged upright on their longitudinal edges. By driving the bottom belts, at least the lower areas of the notes of value standing thereon with their longitudinal edges can be displaced dependent on the direction of rotation of the circulating bottom belts. Preferably, the transport container 10 is designed such that the feed and/or removal opening can be opened and closed. Via the feed and/or removal opening, notes of value can be fed into the storing space 36 and notes of value contained in the storing space 36 can be removed therefrom. In the cover of the transport container 10, at least in the area of the feed and/or removal opening, a non-illustrated height stop is provided so that the banknotes can be positioned relatively accurately at least in the area of the feed and/or removal opening.

At the joints 24, 26, one connecting element 38 each is provided which laterally engages from the end of the respective handle leg 18, 20 through one guide rail each provided laterally in the recess 14. In the present embodiment, the guide rail is formed according to an oblong hole. The connecting element 38 has a preferably cylindrical section projecting laterally from the end of the handle leg 20, which section projects through the guide rail 40 and has a lever 39 at the end opposite to the handle leg 20, the end of the lever 39 which is not connected to the cylindrical section being engaged with an end of a spring 42. In the present embodiment, the spring 42 is formed as a coil spring and is used as a tension spring. The other end of the coil spring is connected to a counter bearing 44. Both the cylindrical section and the lever 39 of the connecting element 38 are rigidly connected to each other and rigidly connected to the end of the handle leg 20. Preferably, the connecting element 38 is formed in one piece with the handle leg 20. When the handle 16 is folded out into the first transport position illustrated in FIG. 3, the spring 42 is tensioned and exerts a restoring force on the handle 16 into the folded-in neutral position.

The handle 16 can be displaced via the guide rail 40 up to the lower end of the guide rail 40 into a second transport position. In the second transport position, the connecting element 38 and the handle 16 have a smaller distance to the underside 46 of the transport container 10 than in the first transport position shown in FIG. 3. When the handle 16 is moved from the first transport position into the second transport position, the spring 42 is tensioned further.

Figure 4:
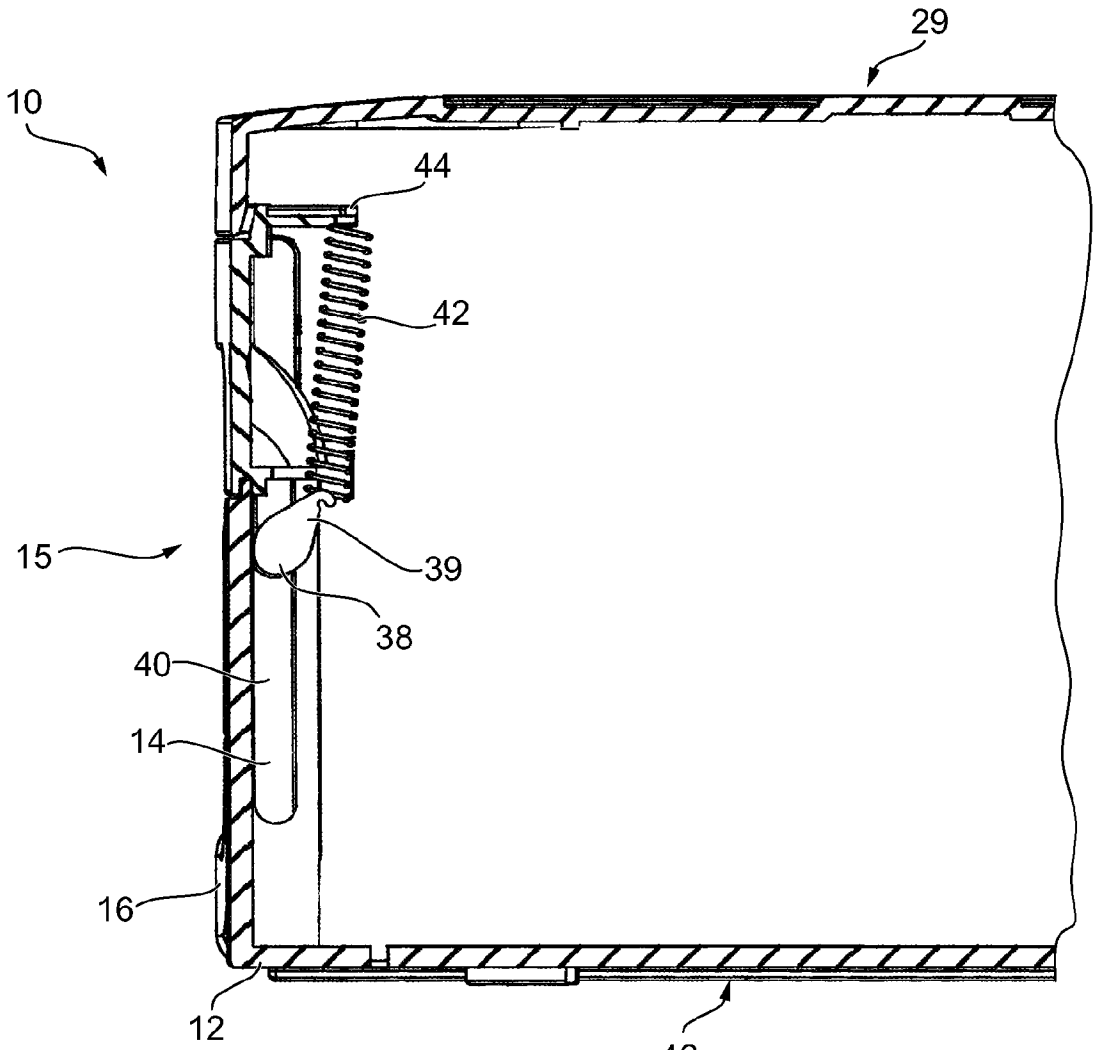

In FIG. 4, the longitudinal section of a portion of the transport container 10 shown in FIG. 3 is illustrated with the handle 16 folded in. Preferably, with this position of the handle, the spring 42 is biased so that the handle 16 is held in the folded-in neutral position. The end of the handle leg 18 engaged with the container body 12 at the joint 24 has a further non-illustrated connecting element which engages with a guide rail provided laterally in the recess 14. This connecting element has no lever in this embodiment. Further, this connecting element is not engaged with a spring. In other embodiments, however, this connecting element provided at the joint 24 can likewise be formed in the same manner as the connecting element 38 and have a lever which engages with a spring which likewise exerts a restoring force on the handle 16 into the folded-in neutral position.

Figure 5:
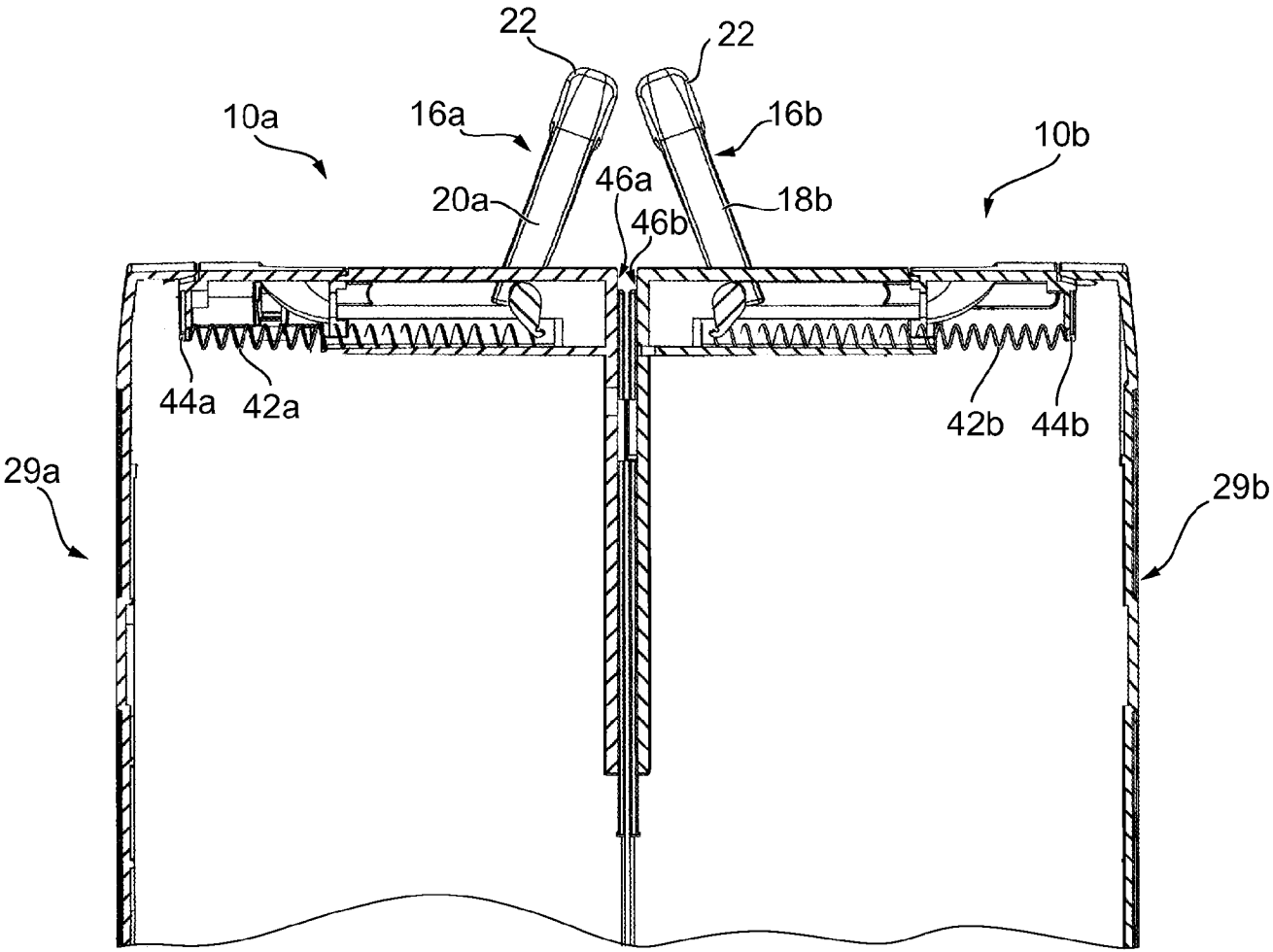
FIG. 5 shows a portion of two transport containers lying against each other for a simultaneous transport, a portion of each transport container being illustrated in the longitudinal section and each of the handles being displaced into a second transport position.

In FIG. 5, two transport containers 10*a*, 10*b* are illustrated which are arranged such that their undersides 18 lie against each other, the longitudinal axes of the containers 10*a*, 10*b* being arranged substantially vertically. Same elements of the transport container 10 described in connection with FIGS. 1 to 4 and of the transport containers 10*a*, 10*b* shown in FIG. 5 are identified with the same reference signs and with the letter "a" for the transport container 10*a* and the letter "b" for the transport container 10*b*. When carried, the front sides 15*a*, 15*b* thus form the upper side of the arrangement formed of the two transport containers 10*a*, 10*b*. Both the handle 16*a* and the handle 16*b* are folded out, wherein each handle 16*a*, 16*b* has only been rotated by an angle smaller than 90° out of the respective neutral position. The handles 16*a*, 16*b* have each been displaced into the second transport position so that the connecting elements 38*a*, 38*b* have each been displaced up to the end of the guide rails 42*a*, 42*b*. As a result thereof, the handle legs 22*a*, 22*b* of the handles 16*a*, 16*b* are approached to each other so far that an adult person can grasp both handles easily with a single hand. In addition, a connecting and/or locking element can be provided to connect the handles 16*a*, 16*b* to each other and to keep the handles 16*a*, 16*b* in the folded-out second position. Alternatively, the containers can lie against each other with their upper sides or another longitudinal side, wherein then the handles are preferably displaced into the second position in the direction of the upper sides or, respectively, the other longitudinal side. In the present embodiment, the handles 16*a*, 16*b* are designed as bow-type handles. In other embodiments, however, other handle forms can likewise be used, which, for example, only have one handle leg that is connected to the container body 12*a*, 12*b*. In the respective first transport position, the respective handle 16*a*, 16*b* is arranged in or near the center-of-gravity plane of the respective container 10*a*, 10*b* so that in this first transport position the handle 16*a*, 16*b* of each of the individual containers 10*a*, 10*b* can be comfortably carried individually and, in the second transport position, the handles are displaced towards the common center-of-gravity plane of two containers lying against each other.

Figure 6:
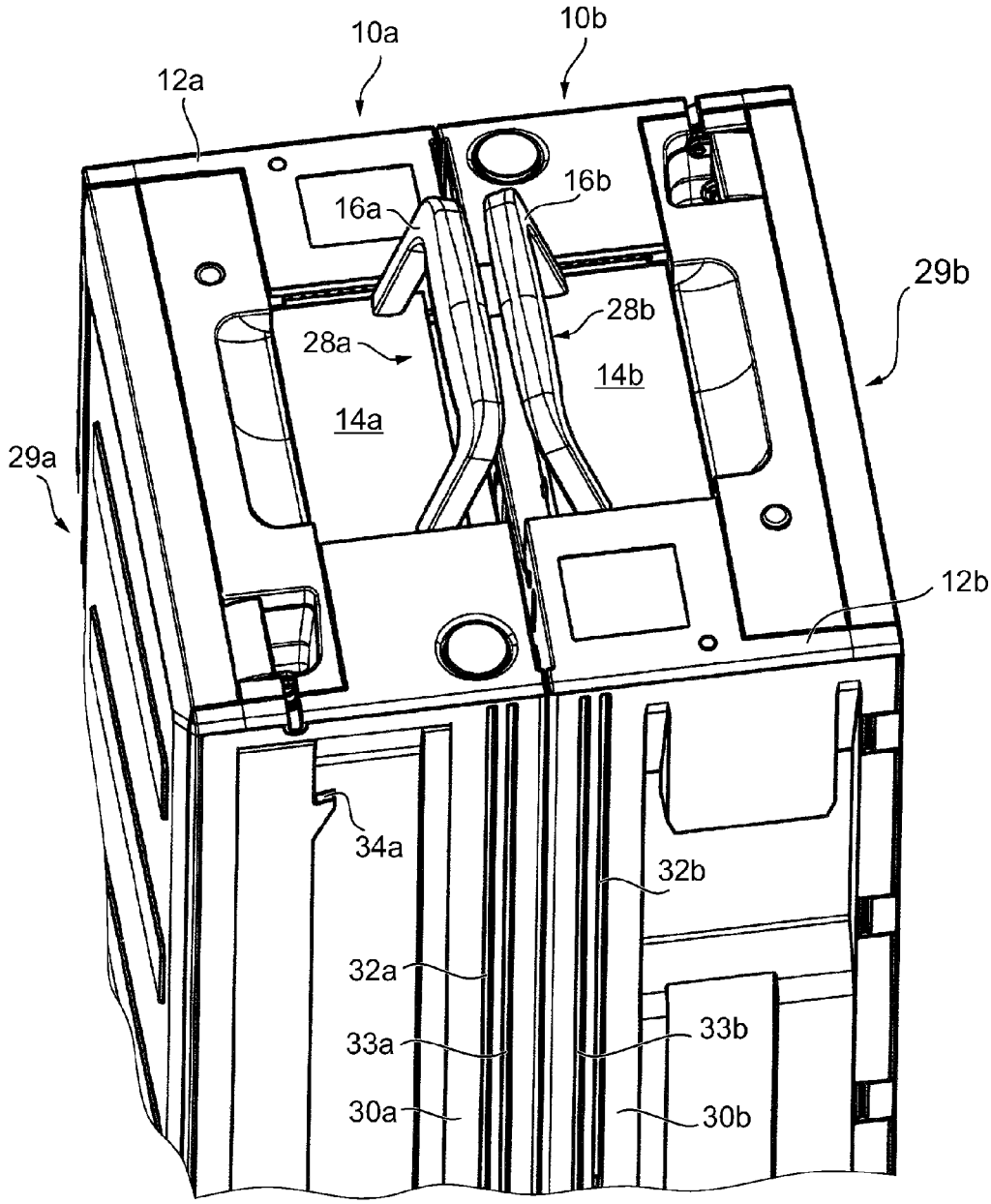
FIG. 6 shows a perspective exterior view of a portion of the transport container of the arrangement according to FIG. 5.

In FIG. 6, a perspective exterior view of a portion of the transport containers 10*a*, 10*b* of the arrangement according to FIG. 5 is shown.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A transport container for storing notes of value, with a container body that has at least one storing area for storing the notes of value, and with a handle connected to the container body, the container body having a center-of-gravity plane, comprising wherein the handle and the container body are connected by at least one connecting element, the body having a recess in an outer surface, the handle not projecting from the recess when the handle is in a folded-in neutral position, the handle being arranged displaceably in the recess of the container body via the connecting element from a first transport position to a second transport position that is different from each of the neutral position and the first transport position, the handle presenting a grasping opening in the first transport position that is in the center-of-gravity plane, the handle is configured to be slidably movable between the first and the second transport positions such that the handle is closer to an exterior edge of the container in the second transport position than when in the first transport position, wherein said exterior edge of the container is located at an interface between an undersurface of the container and a front face of the container, and a restoring element providing a return force to the handle from the second transport position to the first transport position, and from the first transport position to the neutral position.

2. The transport container according to claim 1, wherein the handle is a transport handle designed as a bow-type handle.

3. The transport container according to claim 1, wherein the recess is provided in a front side of the container body, the front side being arranged substantially orthogonally to a longitudinal axis of the container body.

4. The transport container according to claim 1, wherein the center-of-gravity plane of the transport container extends substantially parallel to at least an underside of the transport container.

5. The transport container according to claim 1, wherein the handle projects from the recess in the first transport position so that a grasping opening formed by the handle is arranged in the center-of-gravity plane or in a plane parallel to the center-of-gravity plane.

6. The transport container according to claim 5, wherein the grasping opening is arranged in the center-of-gravity plane in the first transport position and in that the grasping opening is arranged in a plane parallel to the center-of-gravity plane in the second transport position.

7. The transport container according to claim 6, wherein the parallel plane is arranged between the center-of-gravity plane and the underside of the container body.

8. The transport container according to claim 6, wherein the transport container can be arranged in a rack frame and in that the underside of the container body is arranged substantially horizontally and a front side of the container body connected to the handle via the connecting element is arranged substantially vertically, wherein the transport container can be pulled out of the rack frame with the aid of the handle.

9. The transport container according to claim 1, wherein the restoring element is a spring.

10. The transport container according to claim 5, wherein the at least one connecting element engages with at least one guide rail and/or guide groove.

11. The transport container according to claim 5, wherein the center-of-gravity plane of the transport container is arranged vertically in a transport position of the transport container and in that the handle arranged in the first or second transport position projects upwards from a front side of the container body.

12. The arrangement with two transport containers, each of which according to claim 5, wherein a side of a first transport container and a side of a second transport container are arranged opposite to each other, and in that the handle of each transport container can be displaced via the at least one respective connecting element towards the opposite side of the respective other transport container.

13. The arrangement according to claim 12, wherein the distance between the handles is reduced after the handles have been displaced towards the opposite side of the respective other transport container.

14. The arrangement according to claim 12, wherein the distance between the handles can be reduced such that the handles can be jointly grasped by a person with a single hand.

15. The arrangement according to claim 12, wherein the transport containers are arranged opposite to each other with their undersides.

16. A transport container for notes of value, said container comprising:

a box having upper and lower major surfaces, the box having a front face;

said front face having a recess;

a guide rail adjacent the recess;

a handle having a pair of legs, the handle having a neutral position in which the handle is in the recess;

a connecting element on an end of one of the legs, the connecting element being configured to travel along the guide rail; and a biasing element coupled to the connecting element;

wherein the handle is configured to be pivoted out of the recess to a first transport position in which the handle is generally centrally located between the upper and lower surfaces of the box, with the handle being movable to a second transport position closer to the upper or lower surface to facilitate grasping of a handle on a similarly constructed container to carry both containers with one hand of a user;

wherein when the handle is in the first transport position, a return force exerted by the biasing element is operable to move the handle to the neutral position: and wherein when the handle is in the second transport position, the return force exerted by the biasing element is operable to move the handle to the first transport position.

17. The transport container of claim 16, wherein the biasing element is a spring coupled to the connecting element.

18. The transport container of claim 17 wherein the connecting element comprises a cylindrical section riding in the guide rail and having a lever portion, the spring being coupled to the lever portion.

19. The transport container of claim 17, wherein the spring extends across at least a majority of a length of the guide rail when the handle is in the second transport position.

20. The transport container of claim 16, wherein the spring expands to a first length when the handle is moved from the neutral position to the first transport position; and wherein the spring expands to a second length that is greater than the first length when the handle is moved from the first transport position to the second transport position.

21. The transport container of claim 18, wherein the cylindrical section is rotationally stationary when the handle is moved from the first transport position to the second transport position.

22. The transport container of claim 21, wherein the cylindrical section rotates when the handle is moved from the neutral position to the first transport position.

* * * * *